US011776455B2

(12) United States Patent
Wang et al.

(10) Patent No.: US 11,776,455 B2
(45) Date of Patent: Oct. 3, 2023

(54) DRIVING CHIP AND DISPLAY APPARATUS

(71) Applicant: KUNSHAN GO-VISIONOX OPTO-ELECTRONICS CO., LTD, Jiangsu (CN)

(72) Inventors: Yuqing Wang, Kunshan (CN); Xinquan Chen, Kunshan (CN); Zheng Wang, Kunshan (CN); Xiaobao Zhang, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/584,867

(22) Filed: Jan. 26, 2022

(65) Prior Publication Data

US 2022/0148488 A1 May 12, 2022

Related U.S. Application Data

(63) Continuation of application No. PCT/CN2020/118855, filed on Sep. 29, 2020.

(30) Foreign Application Priority Data

Dec. 24, 2019 (CN) ..... 201911349456.8

(51) Int. Cl.
*G09G 3/00* (2006.01)
*G09G 3/20* (2006.01)

(52) U.S. Cl.
CPC ..... *G09G 3/2092* (2013.01); *G09G 2310/08* (2013.01); *G09G 2320/0673* (2013.01); *G09G 2330/028* (2013.01)

(58) Field of Classification Search
CPC ..... G09G 3/2092; G09G 2310/08; G09G 2320/0673; G09G 2330/028
See application file for complete search history.

(56) References Cited

U.S. PATENT DOCUMENTS

2002/0044118 A1 4/2002 Sekido et al.
2008/0054163 A1* 3/2008 Suzunaga ..... G01J 1/44 250/214 A (Continued)

FOREIGN PATENT DOCUMENTS

CN 1476553 A 2/2004
CN 1917004 A 2/2007

(Continued)

OTHER PUBLICATIONS

International Search Report dated Dec. 30, 2020 in corresponding International Application No. PCT/CN2020/118855; 6 pages.

(Continued)

*Primary Examiner* — Michael A Faragalla
(74) *Attorney, Agent, or Firm* — Maier & Maier, PLLC

(57) ABSTRACT

Provided are a driver chip and a display apparatus. The driver chip includes a digital module, an analog module, and a decoupling capacitor. The digital module is configured to generate a digital signal. The analog module includes a reference voltage source and a Gamma voltage generation circuit, an output terminal of the reference voltage source is electrically connected to an input terminal of the Gamma voltage generation circuit, and the Gamma voltage generation circuit is configured to generate a Gamma voltage according to a reference voltage outputted by the reference voltage source. The decoupling capacitor is connected between the digital module and the output terminal of the reference voltage source.

19 Claims, 7 Drawing Sheets

(56) References Cited

U.S. PATENT DOCUMENTS

| | | | | |
|---|---|---|---|---|
| 2014/0191935 | A1* | 7/2014 | Morii | G09G 3/3611 345/92 |
| 2015/0123729 | A1 | 5/2015 | Feldtkeller | |
| 2016/0049113 | A1* | 2/2016 | Park | G09G 3/3208 345/212 |
| 2019/0236996 | A1* | 8/2019 | Yu | G06F 3/0412 |
| 2020/0258688 | A1* | 8/2020 | Berolini | H01G 4/2325 |

FOREIGN PATENT DOCUMENTS

| | | | |
|---|---|---|---|
| CN | 101373574 | A | 2/2009 |
| CN | 101800237 | A | 8/2010 |
| CN | 102929421 | A | 2/2013 |
| CN | 203012575 | U | 6/2013 |
| CN | 104836586 | A | 8/2015 |
| CN | 205721472 | U | 11/2016 |
| CN | 106909192 | A | 6/2017 |
| CN | 206743604 | U | 12/2017 |
| CN | 207067831 | U | 3/2018 |
| CN | 207409244 | U | 5/2018 |
| CN | 108153360 | A | 6/2018 |
| CN | 108475491 | A | 8/2018 |
| CN | 207833373 | U | 9/2018 |
| CN | 106533448 | B | 5/2019 |
| CN | 109862296 | A | 6/2019 |
| CN | 110048710 | A | 7/2019 |
| CN | 110350476 | A | 10/2019 |
| CN | 110767187 | A | 2/2020 |
| CN | 110992870 | A | 4/2020 |

OTHER PUBLICATIONS

First Office Action dated Jan. 28, 2021 in corresponding Chinese Application No. 201911349456.8; 10 pages.

Second Office Action dated Aug. 17, 2021 in corresponding Chinese Application No. 201911349456.8; 12 pages.

* cited by examiner

DRIVING CHIP AND DISPLAY APPARATUS

CROSS-REFERENCE TO RELATED APPLICATIONS

This application is a continuation of International Patent Application No. PCT/CN2020/118855, filed on Sep. 29, 2020, which claims priority to Chinese Patent Application No. 201911349456.8 filed on Dec. 24, 2019, disclosures of both of which are incorporated herein by reference in their entireties.

TECHNICAL FIELD

Embodiments of the present application relate to the technical field of display, for example, a driver chip and a display apparatus.

BACKGROUND

With the development of display technologies, people have higher and higher requirements for display quality.

In the related art, when a display panel displays a special picture, for example, a picture with checkered bright and dark stripes or a picture with checkered bright and dark square regions, a pattern in one direction may shake along another direction, which makes a display effect poor.

SUMMARY

Embodiments of the present application provide a driver chip and a display apparatus to reduce coupling between a digital module and an analog module and improve a display effect.

The embodiments of the present application provide a driver chip which includes a digital module, an analog module, and a decoupling capacitor. The digital module is configured to generate a digital signal. The analog module includes a reference voltage source and a Gamma voltage generation circuit, an output terminal of the reference voltage source is electrically connected to an input terminal of the Gamma voltage generation circuit, and the Gamma voltage generation circuit is configured to generate a Gamma voltage according to a reference voltage outputted by the reference voltage source.

The embodiments of the present application further provide a display apparatus which includes the driver chip provided by any above-mentioned embodiment and further includes a display panel. The display panel is electrically connected to the driver chip.

The embodiments of the present application provide the driver chip and the display apparatus. The driver chip includes the digital module and the analog module. The analog module includes the reference voltage source and the Gamma voltage generation circuit, and the output terminal of the reference voltage source is electrically connected to the input terminal of the Gamma voltage generation circuit. The decoupling capacitor is connected between the digital module and the output terminal of the reference voltage source.

DETAILED DESCRIPTION

Figure 1:
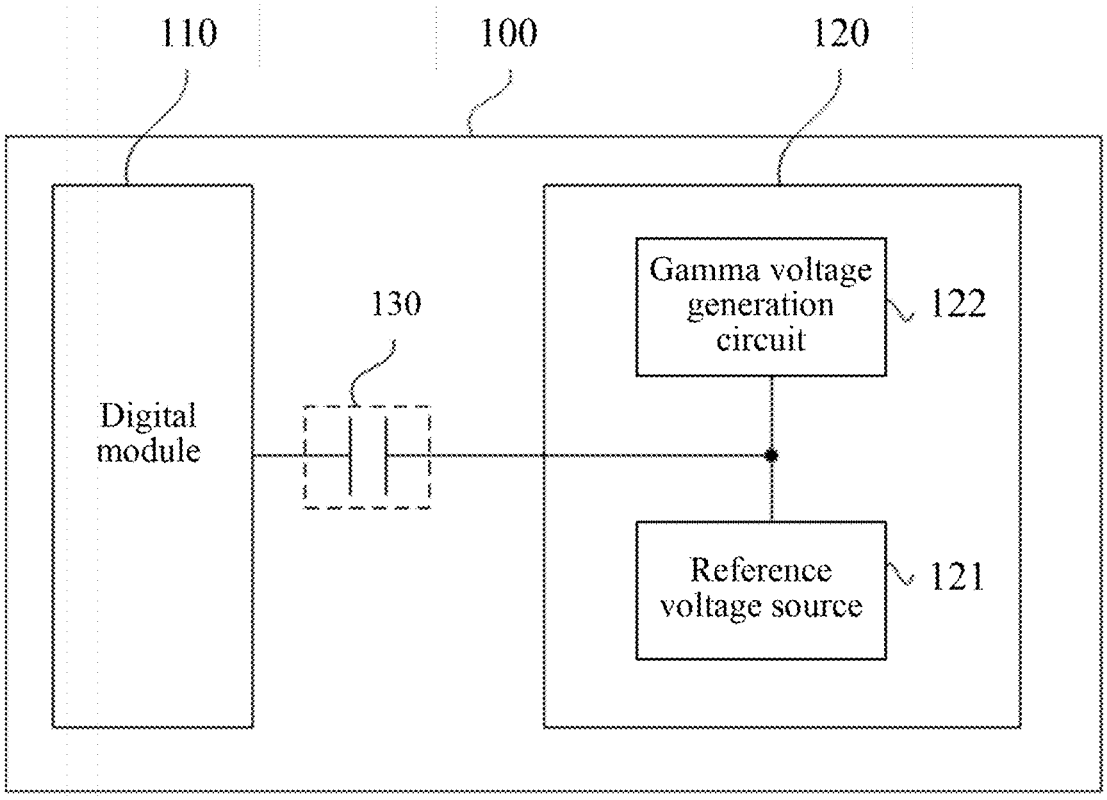
FIG. 1 is a structure diagram of a driver chip according to an embodiment of the present application.

The present application is described below in conjunction with drawings and embodiments. The embodiments set forth below are intended to merely illustrate the present application and not to limit the present application. Additionally, for convenience of description, merely part, not all of the structures related to the present application are illustrated in the drawings.

In general, a pattern in one direction may shake along another direction (that is, the Moire pattern phenomenon) when a display panel displays a special picture. For example, a pattern in the horizontal direction shakes along the longitudinal direction, which makes the display effect poor. It is found that the reason for the above problem is that the display panel includes a plurality of light-emitting devices and that the luminance of the light-emitting device is related to the magnitude of a data voltage provided by the driver chip. Moreover, the driver chip typically includes a digital module and an analog module. The analog module is configured to generate a data voltage (an analog signal) and the digital module is configured to generate a high-level signal and a low-level signal (digital signals). Compared with the digital signal, the analog signal is much more sensitive to noise because the work of an analog circuit depends on continuously changing currents and voltages, any small interference can affect the normal work of the analog module, and a digital circuit has a certain anti-interference ability. In the driver chip which includes both a digital module and an analog module, a digital signal generated by the digital module is a noise source for the analog module, and noise in the digital signal affects an output of the analog module due to a coupling effect between the analog module and the digital module. When the digital module works, stable effective voltages include merely two voltages, that is, a high-level voltage and a low-level voltage. When a voltage outputted by the digital module transits, for example, the voltage transits from a high voltage to a low voltage, a relatively large current needs to be instantaneously extracted from a power line connected to the digital module. The instantaneous large current has an internal resistance effect on the power supply so that an actual voltage outputted by the digital module shakes to further interfere with the analog module. Furthermore, the data voltage outputted by the analog module is unstable so that the Moire pattern phenomenon appears in a picture displayed by the display panel, and the display effect is poor.

The embodiment of the present application provides a driver chip. FIG. 1 is a structure diagram of a driver chip according to the embodiment of the present application. Referring to FIG. 1, a driver chip 100 includes: a digital module 110 and an analog module 120; the analog module 120 includes a reference voltage source 121 and a Gamma voltage generation circuit 122, and an output terminal of the reference voltage source 121 is electrically connected to an input terminal of the Gamma voltage generation circuit 122; and a decoupling capacitor 130 is connected between the digital module 110 and the output terminal of the reference voltage source 121.

The digital module 110 is configured to generate a high-level signal and a low-level signal. Exemplarily, when the driver chip 100 is configured to drive a display panel, the digital module 110 may be configured to generate a clock signal and the clock signal may be provided for a circuit that requires a clock signal for implementing control, such as a gate driver circuit, in the display panel.

The analog module 120 may be configured to generate a continuous analog signal, and the Gamma voltage generation circuit 122 in the analog module 120 is configured to generate a Gamma voltage. The Gamma voltage outputted by the driver chip 100 is a data voltage, and luminance of a sub-pixel in a display apparatus is related to the magnitude of the data voltage. The input terminal of the Gamma voltage generation circuit 122 is electrically connected to the output terminal of the reference voltage source 121, and the Gamma voltage generation circuit 122 may generate a plurality of Gamma voltages according to a reference voltage outputted by the reference voltage source 121.

Figure 2:
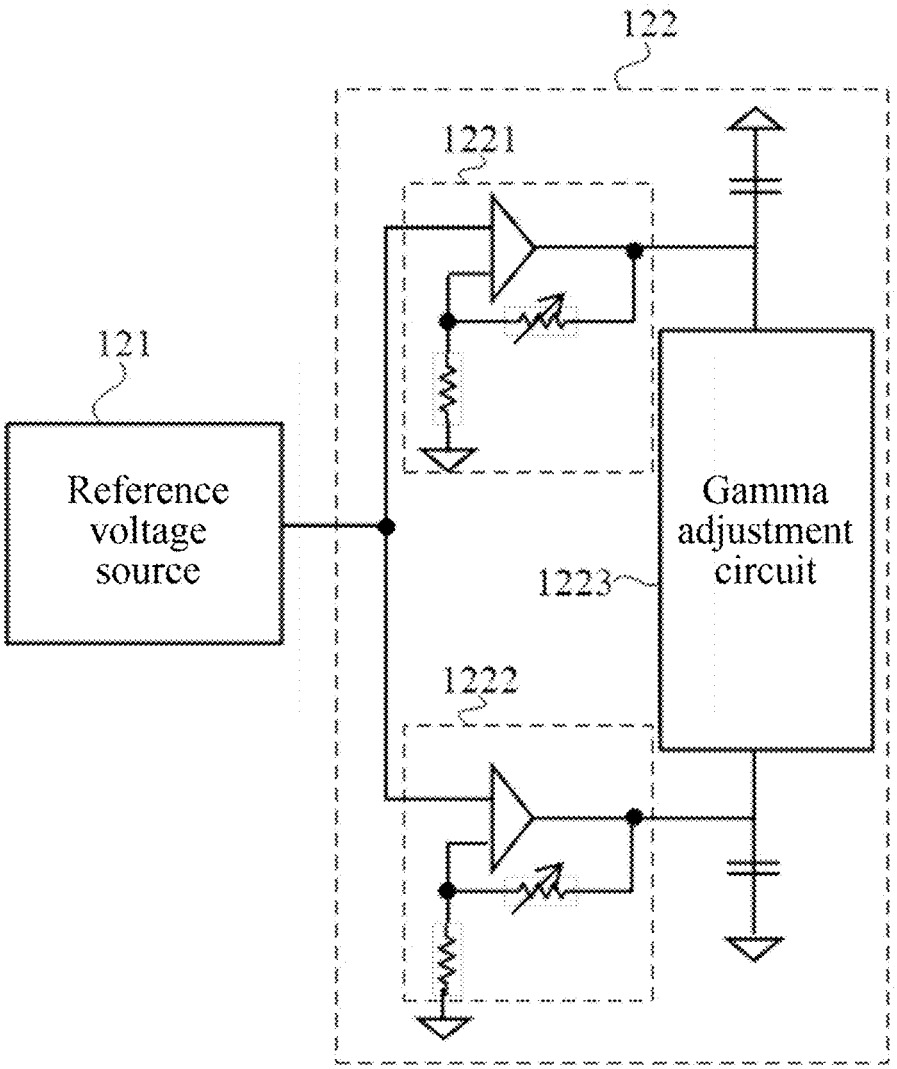
FIG. 2 is a structure diagram of an analog module according to an embodiment of the present application.

FIG. 2 is a structure diagram of the analog module 120 according to an embodiment of the present application. Referring to FIG. 2, in an embodiment, the Gamma voltage generation circuit 122 includes a highest voltage generation circuit 1221, a lowest voltage generation circuit 1222 and a Gamma adjustment circuit 1223. An input terminal of the highest voltage generation circuit 1221 is electrically connected to the output terminal of the reference voltage source 121. An output terminal of the highest voltage generation circuit 1221 is electrically connected to the Gamma adjustment circuit 1223. The highest voltage generation circuit 1221 may generate a highest voltage according to the reference voltage outputted by the reference voltage source 121 and output the generated highest voltage to the Gamma adjustment circuit 1223. An input terminal of the lowest voltage generation circuit 1222 is electrically connected to the output terminal of the reference voltage source 121. An output terminal of the lowest voltage generation circuit 1222 is electrically connected to the Gamma adjustment circuit 1223. The lowest voltage generation circuit 1222 may generate a lowest voltage according to the reference voltage outputted from the reference voltage source 121 and output the generated lowest voltage to the Gamma adjustment circuit 1223. The Gamma adjustment circuit 1223 generates the plurality of Gamma voltages according to the inputted highest voltage and the inputted lowest voltage.

The driver chip 100 may include a plurality of output terminals which may be electrically connected to the Gamma voltage generation circuit 122 such that the Gamma voltages generated by the Gamma voltage generation circuit 122 may be outputted through the driver chip 100. When the driver chip 100 is applied to the display apparatus, each output terminal of the driver chip 100 is connected to a data line and each data line may be connected to a column of sub-pixels in the display panel so that the Gamma voltages, that is, the data voltages, generated by the Gamma voltage generation circuit 122 are transmitted to the sub-pixels through the data lines.

Because the analog module 120 is very sensitive to noise, the digital signal generated by the digital module 110 in the driver chip 100 is an interference source to the analog module 120. Because of the coupling effect between the analog module 120 and the digital module 110, that is, a relatively large coupling capacitance existing between the reference voltage source 121 and the digital module 110, the data voltage generated by the analog module 120 is unstable. Referring to FIG. 1, this embodiment provides the display panel which includes the decoupling capacitor 130. The decoupling capacitor 130 is connected between the digital module 110 and the output terminal of the reference voltage source 121. Thus, when the digital signal outputted by the digital module 110 transits (for example, when the actual voltage outputted by the digital module 110 is caused to shake in the case where the digital signal transits from a high-level signal to a low-level signal and the digital module 110 needs to extract the large current instantaneously from the power line connected to the digital module 110), the interference generated by the shake of the voltage outputted by the digital module 110 to the analog module 120 can be filtered out due to the existence of the decoupling capacitor 130, that it, the decoupling capacitor 130 can play a filtering and decoupling role. Thus, the reference voltage outputted by the reference voltage source 121 is kept stable, and the highest voltage generated by the highest voltage generation circuit 1221 and the lowest voltage generated by the lowest voltage generation circuit 1222 are kept stable so that the data voltage generated by the Gamma adjustment circuit 1223 according to the highest voltage and the lowest voltage is kept stable, thereby improving the Moire pattern phenomenon and the display effect. For a low-grayscale display screen, a change of the data voltage has a significant influence on the luminance of the display screen, so stability of the data voltage improves the display effect of the low-grayscale display screen more significantly.

The embodiment of the present application provides the driver chip which includes the digital module and the analog module. The analog module includes the reference voltage source and the Gamma voltage generation circuit, and the output terminal of the reference voltage source is electrically connected to the input terminal of the Gamma voltage generation circuit. The decoupling capacitor is connected between the digital module and the output terminal of the reference voltage source. The decoupling capacitor can filter out the interference generated by the digital module to the analog module so that the voltage outputted by the reference voltage source is kept stable and the data voltage generated by the Gamma voltage generation circuit according to the reference voltage outputted by the reference voltage source is kept stable. Thus, the Moire pattern phenomenon and the display effect are improved.

Figure 3:
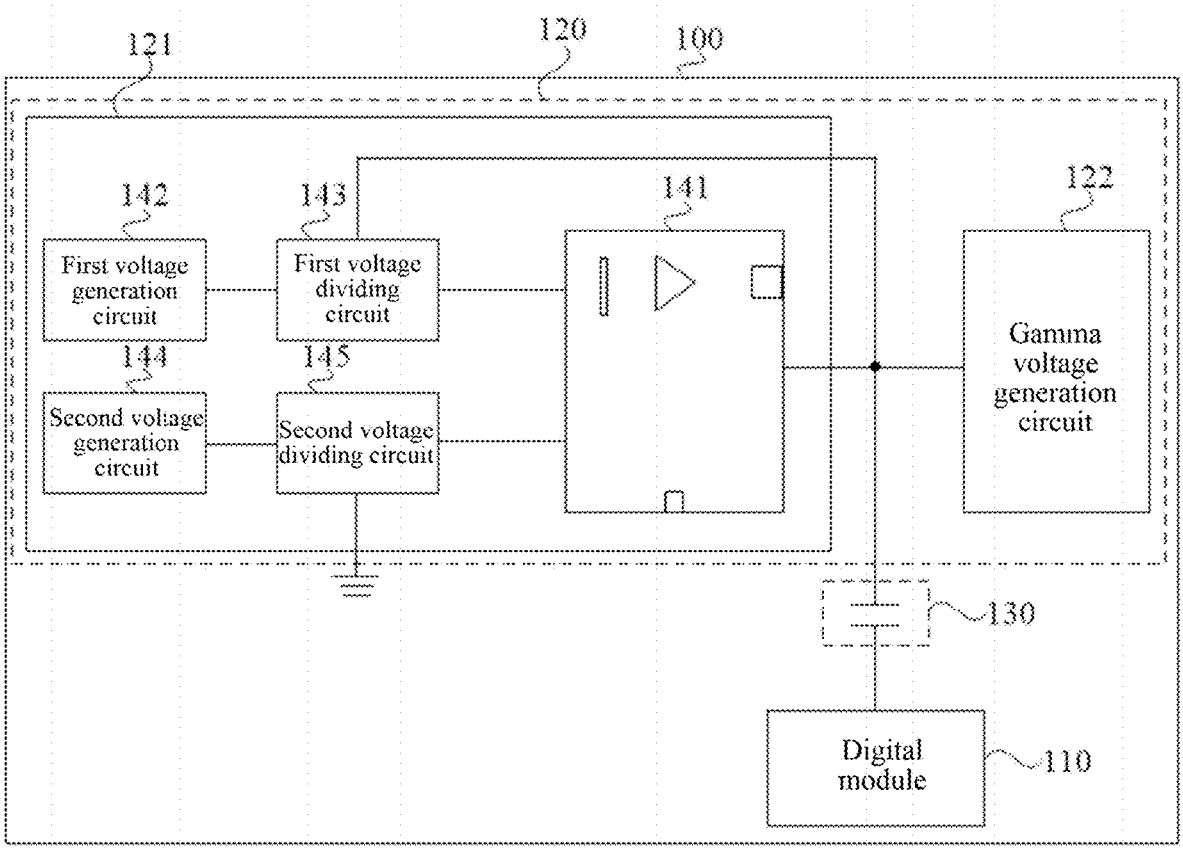
FIG. 3 is a structure diagram of another driver chip according to an embodiment of the present application.

FIG. 3 is a structure diagram of another driver chip according to an embodiment of the present application. Referring to FIG. 3, in an embodiment, in the driver chip 100, the reference voltage source 121 includes an operational amplifier 141, a first voltage generation circuit 142, a first voltage dividing circuit 143, a second voltage generation circuit 144, and a second voltage dividing circuit 145; and the first voltage generation circuit 142 and the second voltage generation circuit 144 are configured to generate voltage amounts having opposite temperature coefficients.

An output terminal of the first voltage generation circuit 142 is electrically connected to a first terminal of the first voltage dividing circuit 143, a second terminal of the first voltage dividing circuit 143 is electrically connected to a non-inverting input terminal of the operational amplifier 141, and a third terminal of the first voltage dividing circuit 143 is electrically connected to an output terminal of the operational amplifier 141.

An output terminal of the second voltage generation circuit 144 is electrically connected to a first terminal of the second voltage dividing circuit 145, a second terminal of the second voltage dividing circuit 145 is electrically connected to an inverting input terminal of the operational amplifier 141, and a third terminal of the second voltage dividing circuit 145 is grounded.

The output terminal of the operational amplifier 141 is electrically connected to the input terminal of the Gamma voltage generation circuit 122.

Figure 4:
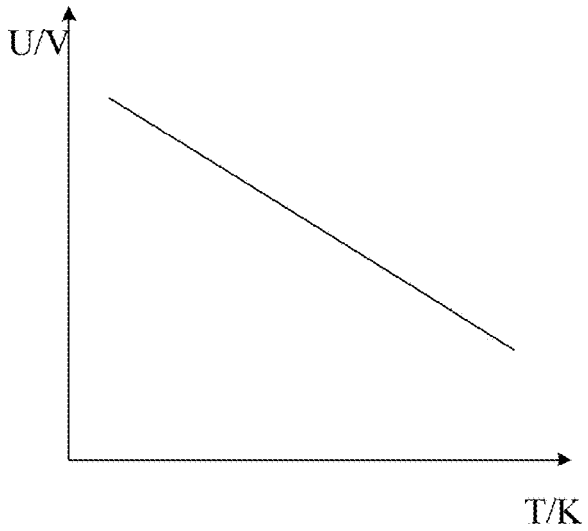
FIG. 4 is a graph of a voltage amount having a negative temperature coefficient according to an embodiment of the present application.
Figure 5:
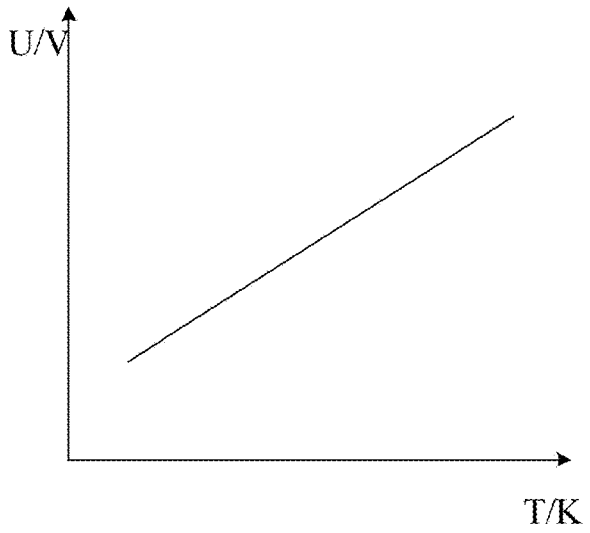
FIG. 5 is a graph of a voltage amount having a positive temperature coefficient according to an embodiment of the present application.

Among voltage sources, some voltage sources may provide voltage amounts having positive temperature coefficients and some voltage sources may provide voltage amounts having negative temperature coefficients. FIG. 4 is a graph of a voltage amount having a negative temperature coefficient according to an embodiment of the present application. FIG. 5 is a graph of a voltage amount having a positive temperature coefficient according to the embodiment of the present application. In FIGS. 4 and 5, the horizontal axis represents temperature T whose unit is K and the vertical axis represents voltage U whose unit is V. According to FIGS. 4 and 5, the voltage amount having the positive temperature coefficient has the following property: the voltage increases with an increase in temperature, and the voltage amount having the negative temperature coefficient has the following property: the voltage decreases with an increase in temperature. The first voltage generation circuit 142 may generate the voltage amount having the positive temperature coefficient or the voltage amount having the negative temperature coefficient, and the second voltage generation circuit 144 may generate the voltage amount having the negative temperature coefficient or the voltage amount having the positive temperature coefficient.

The first voltage generation circuit 142 may generate the voltage amount having the positive temperature coefficient. The first voltage generated by the first voltage generation circuit 142 after being divided by the first voltage dividing circuit 143 is outputted to the non-inverting input terminal of the operational amplifier 141. The second voltage generation circuit 144 generates the voltage amount having the negative temperature coefficient. The second voltage generated by the second voltage generation circuit 144 after being divided by the second voltage dividing circuit 145 is outputted to the inverting input terminal of the operational amplifier 141. That is, the two voltage amounts having opposite temperature coefficients are respectively inputted to the non-inverting input terminal and the inverting input terminal of the operational amplifier 141. After the operational amplifier 141 performs operation processing on the two opposite voltage amounts, the positive temperature coefficient and the negative temperature coefficient of the outputted voltage amounts cancel each other out so that a voltage amount having zero temperature coefficient is obtained, which enables the reference voltage outputted by the reference voltage source 121 not to be drifted along with temperatures. Thus, it is ensured that the Gamma voltage generation circuit 122 generates a stable data voltage according to the reference voltage, which reduces temperature drift, improves an anti-interference ability of the circuit, and improves the display effect when the driver chip is applied to the display apparatus.

Figure 6:
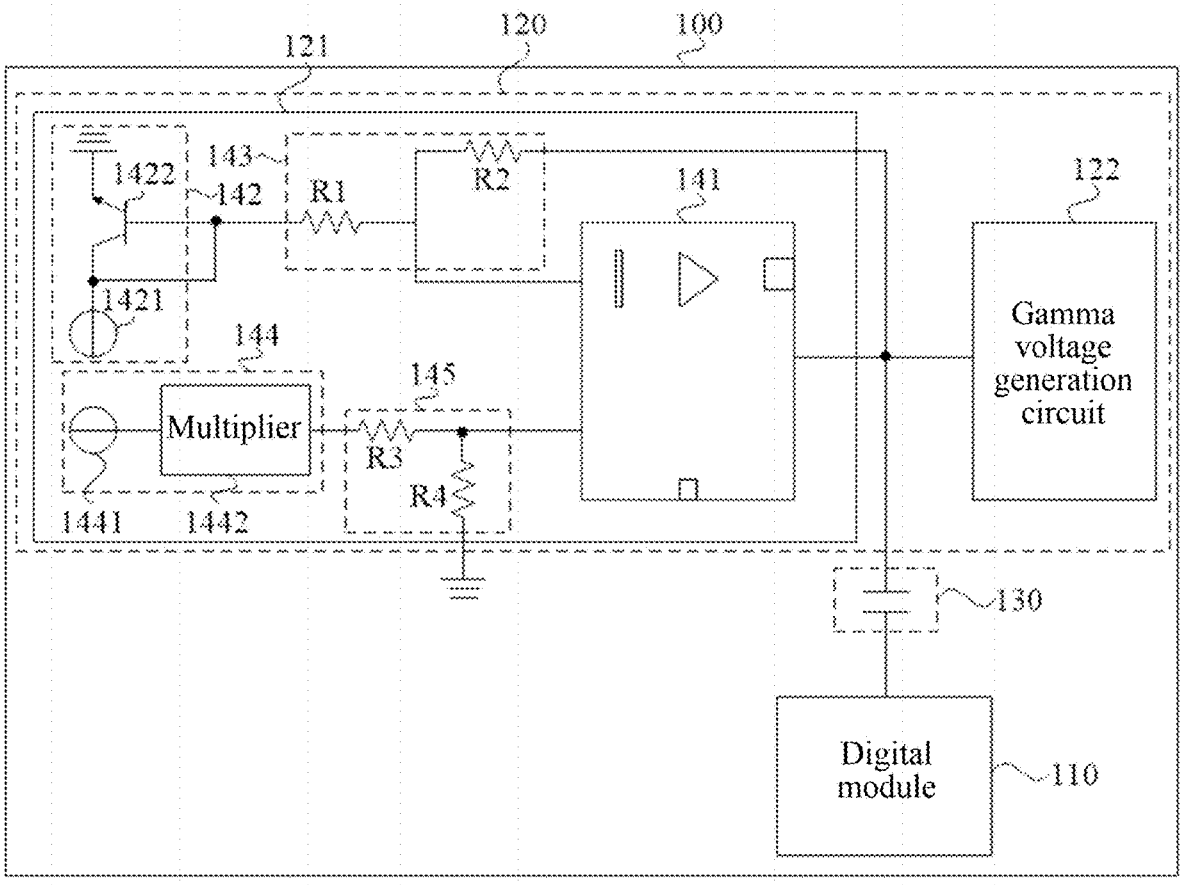
FIG. 6 is a structure diagram of another driver chip according to an embodiment of the present application.

FIG. 6 is a structure diagram of another driver chip according to an embodiment of the present application. Referring to FIG. 6, in an embodiment, the first voltage dividing circuit 143 includes a first resistor R1 and a second resistor R2, a first terminal of the first resistor R1 serves as the first terminal of the first voltage dividing circuit 143, a second terminal of the first resistor R1 is electrically connected to a first terminal of the second resistor R2, the second terminal of the first resistor R1 serves as the second terminal of the first voltage dividing circuit 143, and a second terminal of the second resistor R2 serves as the third terminal of the first voltage dividing circuit 143.

The second voltage dividing circuit 145 includes a third resistor R3 and a fourth resistor R4, a first terminal of the third resistor R3 serves as the first terminal of the second voltage dividing circuit 145, a second terminal of the third resistor R3 is electrically connected to a first terminal of the fourth resistor R4, the second terminal of the third resistor R3 serves as the second terminal of the second voltage dividing circuit 145, and a second terminal of the fourth resistor R4 serves as the third terminal of the second voltage dividing circuit 145.

For the driver chip shown in FIG. 6, the magnitude of the reference voltage Vout outputted by the reference voltage source 121 is that Vout=−R2/R1*Vbe+(1+R2/R1)*R4/(R3+R4)*MVT, where Vbe denotes a voltage between the base and the emitter of the first triode 1422 and MVT denotes a multiple corresponding to the multiplier 1442.

The ratio of the resistance value of the first resistor R1 to the resistance value of the second resistor R2, the ratio of the resistance value of the third resistor R3 to the resistance value of the fourth resistor R4, and the multiple of the multiplier 1442 are adjusted so that corresponding weight values may be applied to the first voltage generated by the first voltage generation circuit 142 and the second voltage generated by the second voltage generation circuit 144, and then the first voltage and the second voltage are inputted to the non-inverting input terminal and the inverting input terminal of the operational amplifier 141, respectively. A voltage amount having an ideal zero temperature coefficient is thus obtained, thereby reducing the temperature drift and ensuring stability of the reference voltage provided by the reference voltage source 121.

A ratio of the resistance value of the second resistor R2 to the resistance value of the first resistor R1 is equal to a ratio of the resistance value of the fourth resistor R4 to the resistance value of the third resistor R3.

When R2/R1=R4/R3, the magnitude of the reference voltage Vout outputted by the reference voltage source 121 is that Vout=R2/R1*(MVT−Vbe).

Furthermore, the common-mode component of the first voltage generated by the first voltage generation circuit 142 and the second voltage generated by the second voltage generation circuit 144 may be suppressed to the maximum extent, and the common-mode interference is thus effectively suppressed. Thus, fluctuation of the voltage outputted by the reference voltage source 121 is reduced, that is, the reference voltage outputted by the reference voltage source 121 is more stable, stability of the data voltage outputted by the Gamma voltage generation circuit 122 is ensured, and the display effect is improved.

With continued reference to FIG. 6, the first voltage generation circuit 142 includes a first voltage source 1421 and a first triode 1422, a base of the first triode 1422 is electrically connected to the first terminal of the first voltage dividing circuit 143, and a first electrode of the first triode 1422 and a second electrode of the first triode 1422 are connected to the first voltage source 1421 and a ground terminal, respectively.

The second voltage generation circuit 144 includes a second voltage source 1441 and a multiplier 1442, the second voltage source 1441 is electrically connected to a first terminal of the multiplier 1442, and a second terminal of the multiplier 1442 is electrically connected to the first terminal of the second voltage dividing circuit 145.

The first electrode of the first triode 1422 may be a collector of the first triode 1422 and the second electrode of the first triode 1422 may be an emitter of the first triode 1422.

Figure 7:
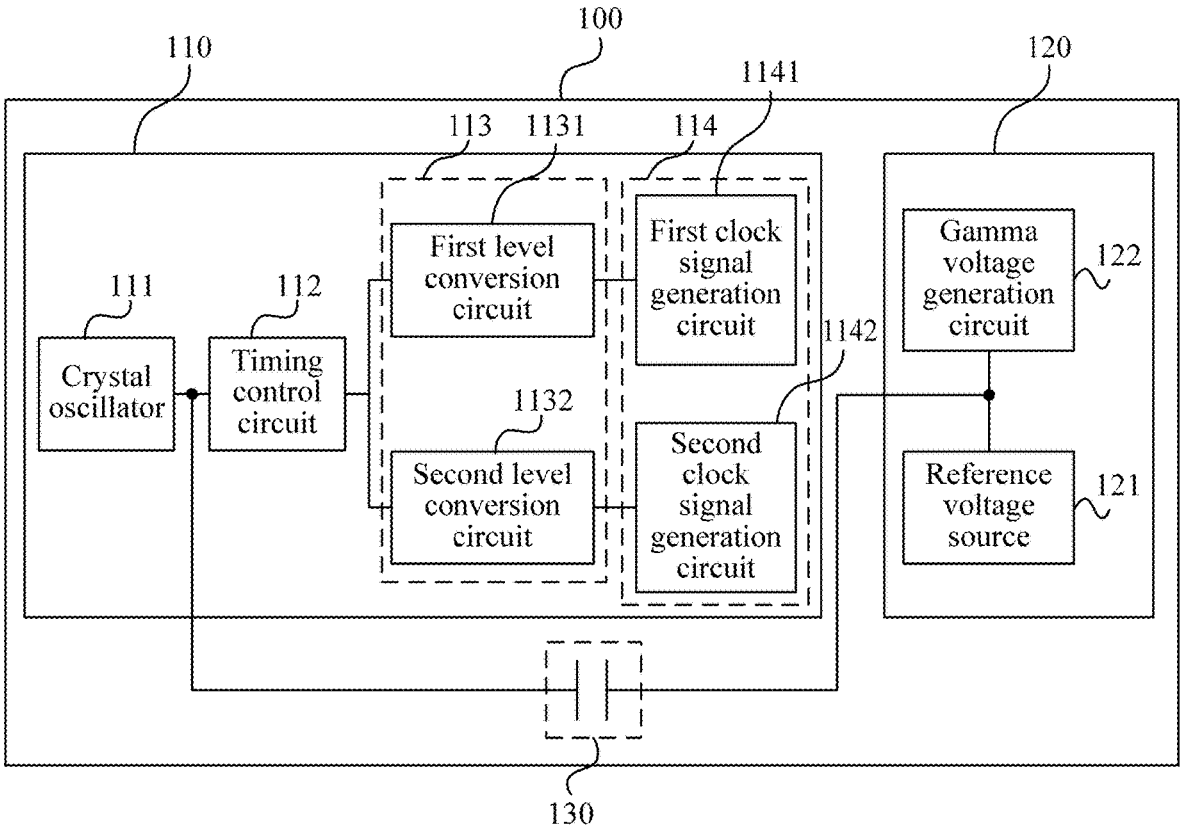
FIG. 7 is a structure diagram of another driver chip according to an embodiment of the present application.

FIG. 7 is a structure diagram of another driver chip according to an embodiment of the present application. Referring to FIG. 7, in an embodiment, the digital module 110 includes a crystal oscillator 111, a timing control circuit 112, a level conversion circuit 113, and a clock signal generation circuit 114, an output terminal of the crystal oscillator 111 is electrically connected to an input terminal of the timing control circuit 112, an output terminal of the timing control circuit 112 is electrically connected to an input terminal of the level conversion circuit 113, an output terminal of the level conversion circuit 113 is electrically connected to an input terminal of the clock signal generation circuit 114, and an output terminal of the clock signal generation circuit 114 is configured to output a clock signal.

A first terminal of the decoupling capacitor 130 is electrically connected to one of the output terminal of the crystal oscillator 111, the output terminal of the timing control circuit 112, the output terminal of the level conversion circuit 113, or the output terminal of the clock signal generation circuit 114, and a second terminal of the decoupling capacitor 130 is electrically connected to the output terminal of the reference voltage source 121.

The crystal oscillator 111 is configured to generate an oscillation frequency and the transistor oscillator may be a quartz crystal oscillator. The crystal oscillator 111 outputs a fixed-frequency signal to the timing control circuit 112. The timing control circuit 112 may disassemble or recombine the fixed-frequency signal outputted by the crystal oscillator 111 and output the fixed-frequency signal which has been disassembled or recombined to the level conversion circuit 113. The level conversion circuit 113 may be used to convert the amplitude of the signal outputted by the timing control circuit 112.

FIG. 7 illustratively shows that the level conversion circuit 113 includes a first level conversion circuit 1131 and a second level conversion circuit 1132. Additionally, FIG. 7 exemplarily shows that the clock signal generation circuit 114 includes a first clock signal generation circuit 1141 and a second clock signal generation circuit 1142. For example, the first clock signal generation circuit 1141 may provide a clock signal for a gate driver circuit in the display apparatus, and the second clock signal generation circuit 1142 may provide a clock signal for a data selector circuit in the display panel. An input terminal of the first level conversion circuit 1131 is electrically connected to the output terminal of the timing control circuit 112, and an input terminal of the second level conversion circuit 1132 is electrically connected to the output terminal of the timing control circuit 112. An input terminal of the first clock signal generation circuit 1141 is electrically connected to an output terminal of the first level conversion circuit, and an output terminal of the first clock signal generation circuit 1141 is configured to output a first clock signal. An input terminal of the second clock signal generation circuit 1142 is electrically connected to an output terminal of the second level conversion circuit, and an output terminal of the second clock signal generation circuit 1142 is configured to output a second clock signal.

The decoupling capacitor 130 in the driver chip 100 is connected between the output terminal of the reference voltage source 121 and one of the output terminal of the crystal oscillator 111, the output terminal of the timing control circuit 112, the output terminal of the level conversion circuit 113, or the output terminal of the clock signal generation circuit 114. Furthermore, the interference of one of the output terminal of the crystal oscillator 111, the output terminal of the timing control circuit 112, the output terminal of the level conversion circuit 113, or the output terminal of the clock signal generation circuit 114 to the reference voltage source 121 can be filtered out to enable a voltage signal outputted by the reference voltage source 121 to be more stable. Thus, the stability of the data voltage outputted by the Gamma voltage generation circuit 122 is ensured, and the Moire pattern phenomenon is improved.

With continued reference to FIG. 7, the first terminal of the decoupling capacitor 130 is electrically connected to the output terminal of the crystal oscillator 111 and the second terminal of the decoupling capacitor 130 is electrically connected to the output terminal of the reference voltage source 121.

The interference caused by a data signal generated by the digital circuit to the analog module 120 results from a signal generated by the crystal oscillator 111. Therefore, the first terminal of the decoupling capacitor 130 is configured to be electrically connected to the output terminal of the crystal oscillator 111 and the second terminal of the decoupling capacitor 130 is electrically connected to the output terminal of the reference voltage source 121, which is beneficial to filtering out the interference caused by the signal outputted by the crystal oscillator 111 to the reference voltage source 121 in the analog module 120. Thus, stability of the voltage signal outputted by the reference voltage source 121 is improved, the stability of the data voltage outputted by the Gamma voltage generation circuit 122 is ensured, and the Moire pattern phenomenon is improved.

Figure 8:
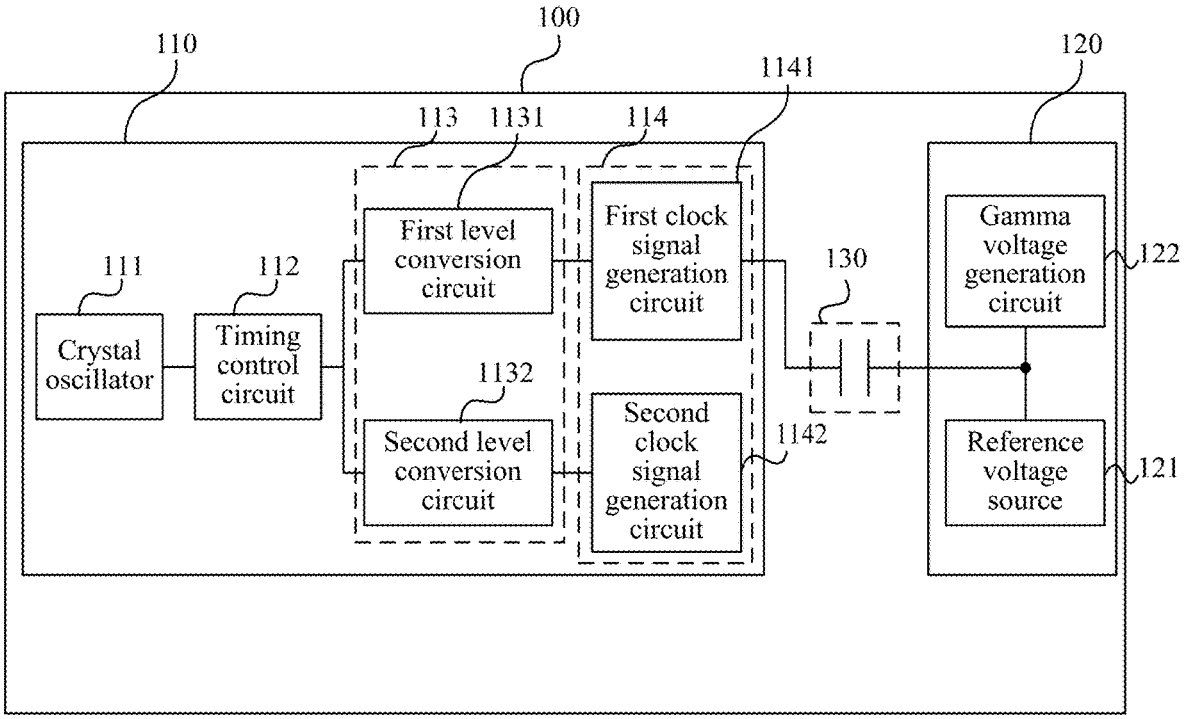
FIG. 8 is a structure diagram of another driver chip according to an embodiment of the present application.

FIG. 8 is a structure diagram of another driver chip according to an embodiment of the present application. Referring to FIG. 8, in an embodiment, the first terminal of the decoupling capacitor 130 is electrically connected to the output terminal of the clock signal generation circuit 114, and the second terminal of the decoupling capacitor 130 is electrically connected to the output terminal of the reference voltage source 121.

Because the signal generated by the digital module 110 is finally a clock signal, it is easy to cause an interference to the reference voltage source 121 in the analog module 120 when the clock signal transits. Therefore, the first terminal of the decoupling capacitor 130 is configured to be electrically connected to the output terminal of the clock signal generation circuit 114 and the second terminal of the decoupling capacitor 130 is configured to be electrically connected to the output terminal of the reference voltage source 121, which is beneficial to filtering out the interference caused by the clock signal to the reference voltage source 121 in the analog module 120. Thus, the stability of the voltage signal outputted by the reference voltage source 121 is improved, the stability of the data voltage outputted by the Gamma voltage generation circuit 122 is ensured, and the Moire pattern phenomenon is improved.

FIG. 8 is illustrated by using an example in which the decoupling capacitor 130 is merely connected between the first clock signal generation circuit and an output terminal of the reference voltage source 121. The decoupling capacitor 130 may also be connected between another clock signal generation circuit of the digital module 110 and the reference voltage source 121, which is not limited in the embodiment of the present application.

Based on the above technical solutions, a capacitance value of the decoupling capacitor is from 0.2 microfarads to 5 microfarads in magnitude.

The capacitance value of the decoupling capacitor is 0.2 microfarads so that the decoupling capacitor has a small area when playing a filtering role, which facilitates the configuration of the decoupling capacitor.

The capacitance value of the decoupling capacitor is 5 microfarads, which is beneficial to filtering out low-frequency interference signals.

Figure 9:
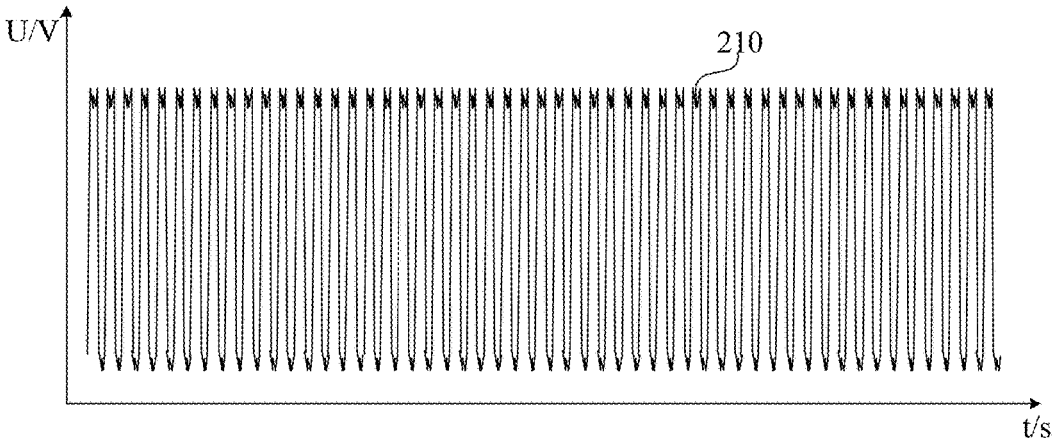
FIG. 9 is a graph of a data voltage outputted by a driver chip according to an embodiment of the present application.
Figure 10:
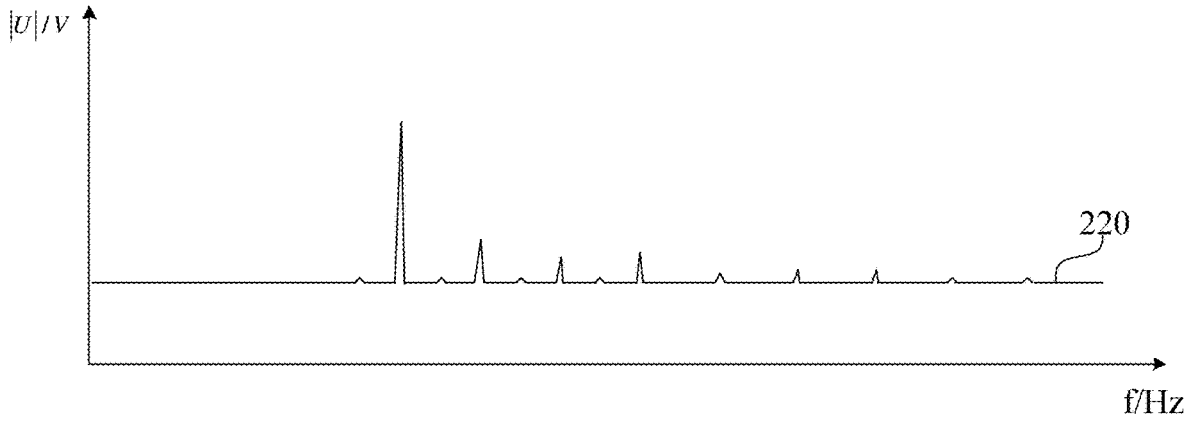
FIG. 10 is a graph obtained by performing Fourier transform on the data voltage shown in FIG. 9.

The capacitance value of the decoupling capacitor is 2 microfarads so that the decoupling capacitor has a small area and the low-frequency interference signals can be filtered out, which is beneficial to improving the Moire pattern phenomenon. FIG. 9 is a graph of a data voltage outputted by a driver chip according to an embodiment of the present application. FIG. 10 is a graph obtained by performing Fourier transform on the data voltage shown in FIG. 9. Referring to FIG. 9, the curve 210 in FIG. 9 is a corresponding curve of the data voltage when the capacitance value of the decoupling capacitor is set to 2 microfarads. In FIG. 9, the horizontal axis represents time t and the vertical axis represents a data voltage U. The curve 220 in FIG. 10 is a curve obtained by performing Fourier transform on the data voltage curve shown in FIG. 9. In FIG. 10, the horizontal axis represents the frequency f and the vertical axis represents the data voltage module value |U|. As can be seen from FIGS. 9 and 10, interference signals below 60 Hz in the data voltage are filtered out by the decoupling capacitor so that the stability of the data voltage and the Moire pattern phenomenon are improved.

Figure 11:
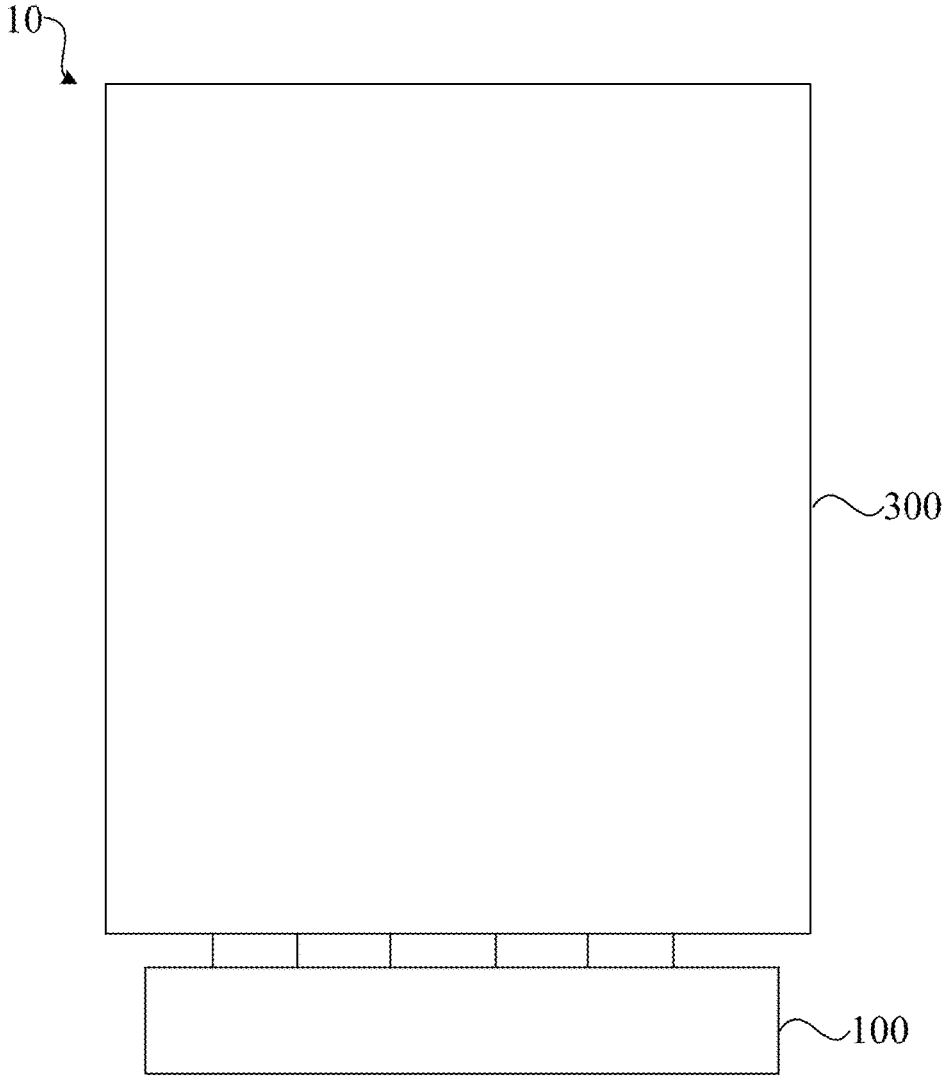
FIG. 11 is a structure diagram of a display apparatus according to an embodiment of the present application.

The embodiment of the present application further provides a display apparatus. FIG. 11 is a structure diagram of the display apparatus according to an embodiment of the present application. Referring to FIG. 11, the display apparatus 10 provided by the embodiment of the present application includes the driver chip 100 provided by any of the above embodiments of the present application and further includes a display panel 300. The display panel 300 is electrically connected to the driver chip 100. The display apparatus may be a mobile phone, a computer, a television, a smart wearable display apparatus, and the like, which is not limited in the embodiment of the present application.

What is claimed is:

1. A driver chip, comprising:

a digital signal generator;

an analog signal generator which comprises a reference voltage source and a Gamma voltage generation circuit, wherein an output terminal of the reference voltage source is electrically connected to an input terminal of the Gamma voltage generation circuit, and the Gamma voltage generation circuit is configured to generate a Gamma voltage according to a reference voltage outputted by the reference voltage source; and a decoupling capacitor, wherein the decoupling capacitor is connected between the digital signal generator and the output terminal of the reference voltage source, wherein the reference voltage source comprises an operational amplifier, a first voltage generation circuit, a first voltage dividing circuit, a second voltage generation circuit and a second voltage dividing circuit, and the first voltage generation circuit and the second voltage generation circuit are configured to generate voltage amounts having opposite temperature coefficients;

wherein an output terminal of the first voltage generation circuit is electrically connected to a first terminal of the first voltage dividing circuit, a second terminal of the first voltage dividing circuit is electrically connected to a non-inverting input terminal of the operational amplifier, and a third terminal of the first voltage dividing circuit is electrically connected to an output terminal of the operational amplifier;

wherein an output terminal of the second voltage generation circuit is electrically connected to a first terminal of the second voltage dividing circuit, a second terminal of the second voltage dividing circuit is electrically connected to an inverting input terminal of the operational amplifier, and a third terminal of the second voltage dividing circuit is grounded; and wherein the output terminal of the operational amplifier is electrically connected to the input terminal of the Gamma voltage generation circuit.

2. The driver chip according to claim 1, wherein the first voltage dividing circuit comprises a first resistor and a second resistor, and wherein a first terminal of the first resistor serves as the first terminal of the first voltage dividing circuit, a second terminal of the first resistor is electrically connected to a first terminal of the second resistor, the second terminal of the first resistor serves as the second terminal of the first voltage dividing circuit, and a second terminal of the second resistor serves as the third terminal of the first voltage dividing circuit.

3. The driver chip according to claim 2, wherein the second voltage dividing circuit comprises a third resistor and a fourth resistor, and wherein a first terminal of the third resistor serves as the first terminal of the second voltage dividing circuit, a second terminal of the third resistor is electrically connected to a first terminal of the fourth resistor, the second terminal of the third resistor serves as the second terminal of the second voltage dividing circuit, and a second terminal of the fourth resistor serves as the third terminal of the second voltage dividing circuit.

4. The driver chip according to claim 3, wherein a ratio of the resistance value of the second resistor to the resistance value of the first resistor is equal to a ratio of the resistance value of the fourth resistor to the resistance value of the third resistor.

5. The driver chip according to claim 1, wherein the first voltage generation circuit comprises a first voltage source and a first triode, and wherein a base of the first triode is electrically connected to the first terminal of the first voltage dividing circuit, and a first electrode of the first triode and a second electrode of the first triode are respectively connected to the first voltage source and a ground terminal.

6. The driver chip according to claim 5, wherein the second voltage generation circuit comprises a second voltage source and a multiplier, and wherein the second voltage source is electrically connected to a first terminal of the multiplier, and a second terminal of the multiplier is electrically connected to the first terminal of the second voltage dividing circuit.

7. The driver chip according to claim 1, wherein the digital signal generator comprises a crystal oscillator, a timing control circuit, a level conversion circuit and a clock signal generation circuit, wherein an output terminal of the crystal oscillator is electrically connected to an input terminal of the timing control circuit, an output terminal of the timing control circuit is electrically connected to an input terminal of the level conversion circuit, an output terminal of the level conversion circuit is electrically connected to an input terminal of the clock signal generation circuit, and an output terminal of the clock signal generation circuit is configured to output a clock signal.

8. The driver chip according to claim 7, wherein a first terminal of the decoupling capacitor is electrically connected to one of the output terminal of the crystal oscillator, the output terminal of the timing control circuit, the output terminal of the level conversion circuit and the output terminal of the clock signal generation circuit, and wherein a second terminal of the decoupling capacitor is electrically connected to the output terminal of the reference voltage source.

9. The driver chip according to claim 8, wherein the first terminal of the decoupling capacitor is electrically connected to the output terminal of the crystal oscillator, and wherein the second terminal of the decoupling capacitor is electrically connected to the output terminal of the reference voltage source.

10. The driver chip according to claim 8, wherein the first terminal of the decoupling capacitor is electrically connected to the output terminal of the clock signal generation circuit and the second terminal of the decoupling capacitor is electrically connected to the output terminal of the reference voltage source.

11. The driver chip according to claim 1, wherein a capacitance value of the decoupling capacitor is from 0.2 microfarads to 5 microfarads.

12. The driver chip according to claim 7, wherein the level conversion circuit comprises a first level conversion circuit and a second level conversion circuit, an input terminal of the first level conversion circuit is electrically connected to the output terminal of the timing control circuit, and an input terminal of the second level conversion circuit is electrically connected to the output terminal of the timing control circuit; and wherein the clock signal generation circuit comprises a first clock signal generation circuit and a second clock signal generation circuit, an input terminal of the first clock signal generation circuit is electrically connected to an output terminal of the first level conversion circuit, an output terminal of the first clock signal generation circuit is configured to output a first clock signal, an input terminal of the second clock signal generation circuit is electrically connected to an output terminal of the second level conversion circuit, and an output terminal of the second clock signal generation circuit is configured to output a second clock signal.

13. The driver chip according to claim 12, wherein a first terminal of the decoupling capacitor is electrically connected to the output terminal of the first clock signal generation circuit and a second terminal of the decoupling capacitor is electrically connected to the output terminal of the reference voltage source.

14. The driver chip according to claim 1, wherein the first voltage generation circuit is configured to generate a voltage amount having a positive temperature coefficient and the second voltage generation circuit is configured to generate a voltage amount having a negative temperature coefficient.

15. The driver chip according to claim 10, wherein a capacitance value of the decoupling capacitor is 0.2 microfarads.

16. The driver chip according to claim 10, wherein a capacitance value of the decoupling capacitor is 5 microfarads.

17. The driver chip according to claim 10, wherein a capacitance value of the decoupling capacitor is 2 microfarads.

18. The driver chip according to claim 5, wherein the first electrode of the first triode is a collector of the first triode and the second electrode of the first triode is an emitter of the first triode.

19. A display apparatus, comprising the driver chip according to claim 1 and further comprising a display panel, wherein the display panel is electrically connected to the driver chip.

* * * * *